US007025636B2

(12) United States Patent
Allen

(10) Patent No.: US 7,025,636 B2
(45) Date of Patent: Apr. 11, 2006

(54) ADAPTOR FOR MAKING BROKEN CONNECTORS SERVICEABLE

(76) Inventor: George Allen, 4405 Warner Pl., Nashville, TN (US) 37205

( * ) Notice: Subject to any disclaimer, the term of this patent is extended or adjusted under 35 U.S.C. 154(b) by 0 days.

(21) Appl. No.: 10/927,341

(22) Filed: Aug. 26, 2004

(65) Prior Publication Data

US 2006/0046575 A1 Mar. 2, 2006

(51) Int. Cl.
*H01R 31/00* (2006.01)

(52) U.S. Cl. ..... 439/638; 439/357

(58) Field of Classification Search ..... 439/344, 439/353, 354, 357, 595, 638, 676
See application file for complete search history.

(56) References Cited

U.S. PATENT DOCUMENTS

| | | | | | |
|---|---|---|---|---|---|
| 4,074,928 | A | | 2/1978 | Johnston | 339/91 |
| 4,295,702 | A | * | 10/1981 | Snyder | 439/425 |
| 4,611,875 | A | * | 9/1986 | Clarke et al. | 439/638 |
| 4,647,726 | A | * | 3/1987 | Blum | 379/435 |
| 4,714,440 | A | * | 12/1987 | Hutchins | 439/676 |
| 4,870,840 | A | * | 10/1989 | Klein | 70/57 |
| 4,904,209 | A | * | 2/1990 | Nelson | 439/676 |
| 4,946,404 | A | * | 8/1990 | Takenouchi et al. | 439/352 |
| 5,328,390 | A | * | 7/1994 | Johnston et al. | 439/638 |
| 5,411,405 | A | | 5/1995 | McDaniels et al. | 439/131 |
| 5,425,172 | A | * | 6/1995 | Carswell et al. | 29/884 |
| 5,556,295 | A | * | 9/1996 | McFadden et al. | 439/301 |
| 5,608,260 | A | * | 3/1997 | Carper et al. | 257/666 |
| 5,613,869 | A | | 3/1997 | Erlich et al. | 439/344 |
| 5,651,690 | A | * | 7/1997 | Klas et al. | 439/352 |
| 5,666,408 | A | * | 9/1997 | Lao | 379/442 |
| 5,773,332 | A | | 6/1998 | Glad | 439/344 |
| 5,938,480 | A | | 8/1999 | Aldous et al. | 439/676 |
| 5,951,330 | A | * | 9/1999 | Reichard et al. | 439/676 |
| 5,971,777 | A | | 10/1999 | Garside | 439/131 |
| 5,993,237 | A | * | 11/1999 | Kern et al. | 439/344 |
| 6,080,001 | A | | 6/2000 | Wong | 439/344 |
| 6,089,922 | A | | 7/2000 | Glad et al. | 439/676 |
| 6,116,963 | A | * | 9/2000 | Shutter | 439/676 |
| 6,139,350 | A | * | 10/2000 | Mathesius | 439/357 |
| 6,280,226 | B1 | | 8/2001 | Takatsuki et al. | 439/354 |
| 6,514,099 | B1 | * | 2/2003 | Endo | 439/489 |
| 6,577,243 | B1 | * | 6/2003 | Dannenmann et al. | 340/815.45 |
| 6,579,113 | B1 | * | 6/2003 | Kodama | 439/358 |
| 2002/0016107 | A1 | * | 2/2002 | Bellemon et al. | 439/638 |

* cited by examiner

*Primary Examiner*—Paula A. Bradley
*Assistant Examiner*—Larisa Tsukerman
(74) *Attorney, Agent, or Firm*—Waddey & Patterson; I. C. Waddey, Jr.

(57) ABSTRACT

An electrical adapter (16) for receiving a male plug (10) having male plug electrical contacts (30) and having a broken latching tab (12), the male plug (10) being constructed to be received in a receiving unit (18) in a plugging fashion. The adapter (16) also comprises a female end (20) for electrically receiving the male plug (10) and a male end (22) for electrically connecting the adapter (16) to the receiving unit (18) in a plugging fashion.

21 Claims, 3 Drawing Sheets

ADAPTOR FOR MAKING BROKEN CONNECTORS SERVICEABLE

BACKGROUND OF THE INVENTION

This application relates to energy transmission connectors, including those attached to the ends of cords carrying electrical and optical waves, and more particularly to adaptors for making broken connectors serviceable.

BRIEF DESCRIPTION OF PRIOR ART

Energy transmission lines, such as telephone lines, fiber optic lines, Ethernet lines and the like are often connected to outlets or to other devices by flexible conductors or lines having plug-in type connectors on their ends. One example of such a plug-in connector is the RJ-11 connector commonly used to connect a telephone line to a wall outlet. The RJ-11 connector is typically formed of plastic, and it has a flexible latching tab (sometimes referred to as a connector tab) integrally molded as part of the plastic connector. The RJ 45 Ethernet connector and the MT RJ and LC fiber-optic connectors also have flexible latching tabs. When the connector is inserted into the port in a machine or into a wall outlet, the latching tab flexes as it rides over a pair of spaced apart bosses inside the female receptacle and snaps into a locked attachment with the receptacle with flared shoulders of the tab engaging the bosses. When it is time to disconnect the connector, the tab, extending outside the receptacle, is pressed down to disengage the flared shoulders from the bosses so that the connector can be removed.

It is not uncommon for these latching tabs to break off in use, generally requiring that the energy transmission lines be discarded and replaced with new ones. Replacement of the broken connector is impractical because it involves special crimping tools and know-how not generally possessed by the users of these connectors.

One somewhat analogous problem and solution is seen in U.S. Pat. No. 4,074,928 to Johnson. The Johnson device, however, is designed for use with a very different type of connector, and it uses a replacement latch to replace the broken latch, by attaching the replacement latch to two apertures found on the connector. The Johnson device is not applicable to connectors of the type commercially available and in use today.

Thus there is a need for an adapter which would allow repair, rather than replacement, of these broken connectors.

BRIEF SUMMARY OF THE INVENTION

The present invention is an adapter which includes a female end and a male end and can rectify the situation of a male plug having a broken latching tab. The female end of the electrical adapter contains a retaining tab to hold the male plug securely into place and it also has the ability to be released in order to release the male plug. The male end of the adapter is used to connect the adapter to the receiving unit. The male end includes an unbroken latching tab and is similar in shape to the male plug except for the latching tab. The receiving unit may be a wall outlet, electrical, telephone, or otherwise, or an electrical device, such as a telephone, computer, etc. among other things.

Also included within the present invention is a method for connecting a male plug with a broken latching tab to the female end of a receiving unit. This method includes providing an adaptor with an female end and a male end, the female end of the adaptor having a retaining tab, inserting the broken male plug into the female end of the adaptor, pushing on the male plug until the retaining tab within the female end of the adaptor engages the tab to fix it in place inside the female end of the adaptor, and inserting the male end of the adapter into the female end of the receiving unit, thereby connecting the overall adapter and male plug to the receiving unit.

BRIEF DESCRIPTION OF THE DRAWINGS

The electrical adapter of the present invention is further described with reference to the accompanying drawings in which.

DETAILED DESCRIPTION OF THE PREFERRED EMBODIMENTS

The invention is designed to make serviceable a broken plug attached to the end of an energy transmission line. The line could be telephone line, a fiber-optic line, an Ethernet line or most any other energy transmission line. However, for simplicity sake, the preferred embodiment will be described in conjunction with a broken plug of the RJ-11 type used in conjunction with telephone lines, realizing that one of ordinary skill in the art will readily see how the invention could be used to repair or make serviceable all types of plugs where the plug has a broken retaining tab or connector arm.

Figure 1:
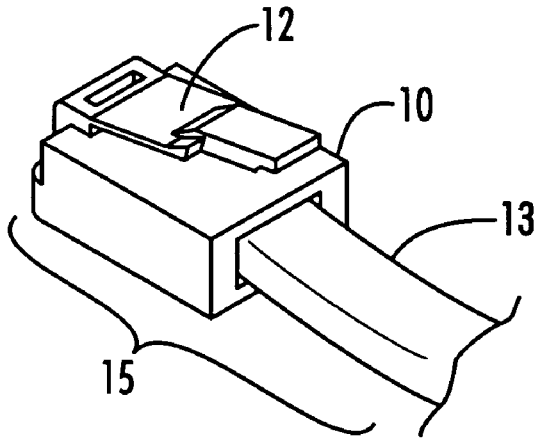
FIG. 1 (PRIOR ART)
FIG. 1 is a perspective view of the male plug of the prior art.
Figure 2:
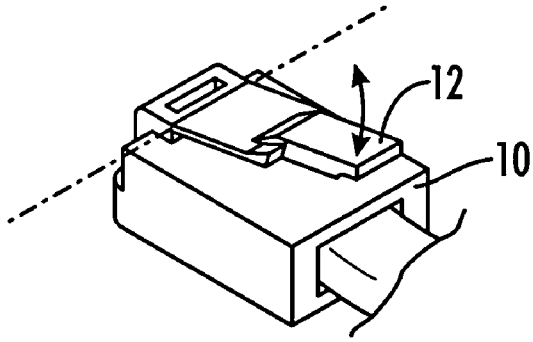
FIG. 2 is a perspective view of the male plug of FIG. 1, demonstrating the latching tab of the male plug and its propensity to easily break off of the male plug.
Figure 3:
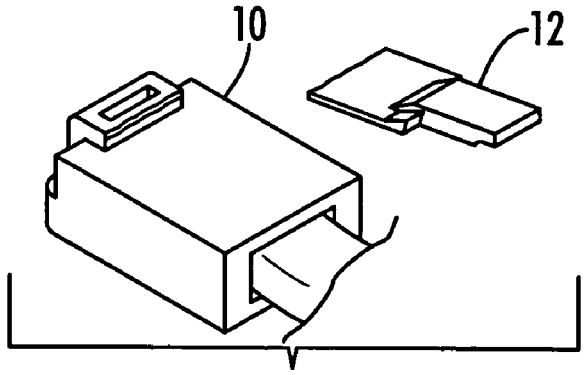
FIG. 3 is a perspective view of the male plug of both FIG. 1 and FIG. 2 with a broken latching tab, which is detached from the male plug.
Figure 4:
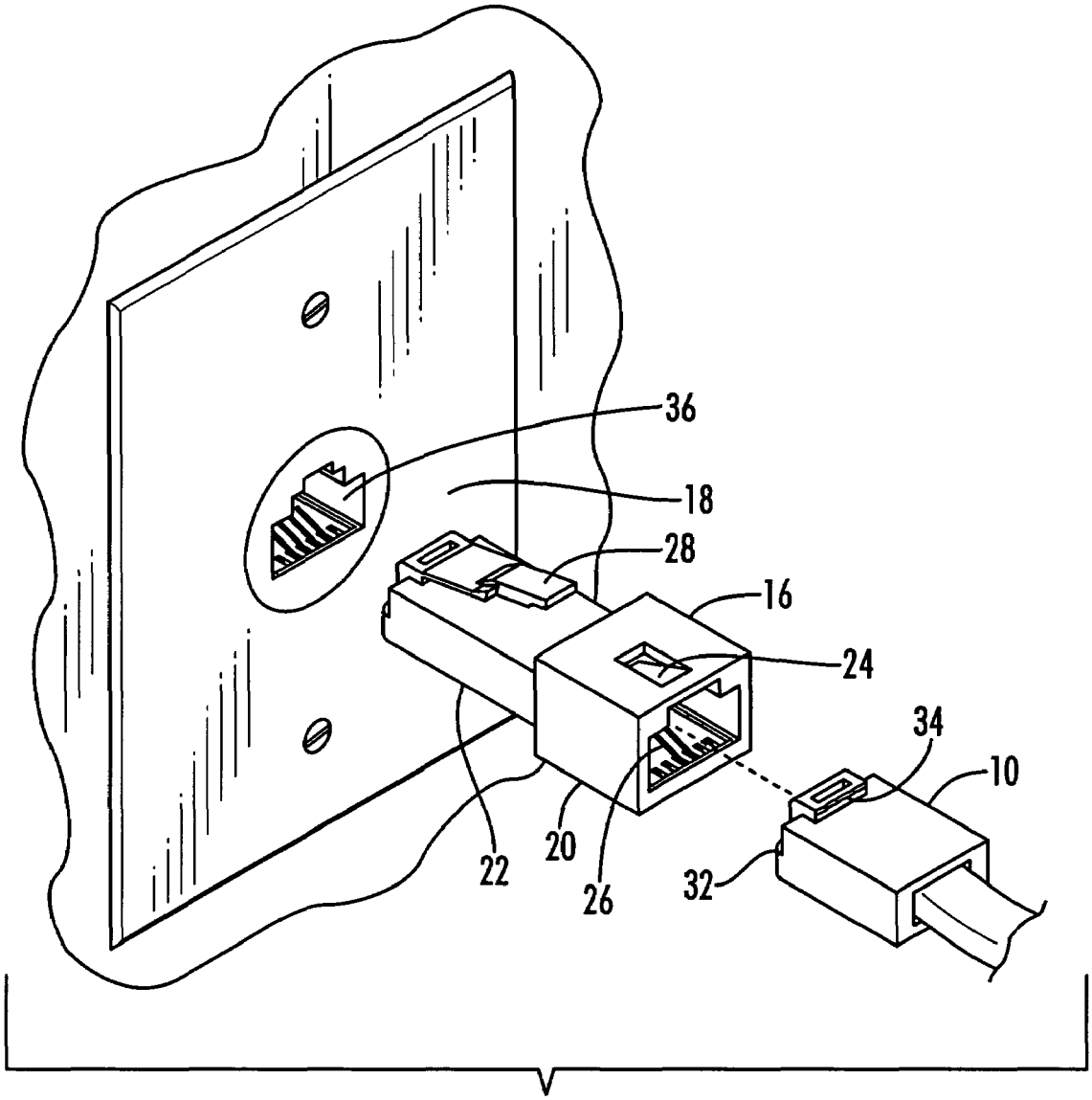
FIG. 4 is a perspective view of the electrical adapter of the present invention, the male plug of FIG. 3 with broken latching tab, and receiving unit.
Figure 5:
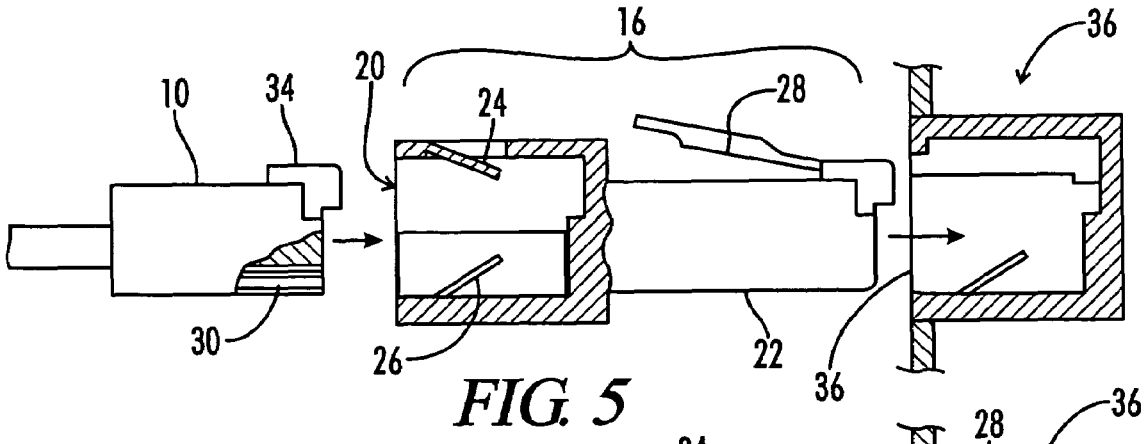
FIG. 5 is a partially sectioned side view of the adapter of FIG. 4, male plug with broken latching tab of FIG. 4, and receiving unit.
Figure 6:
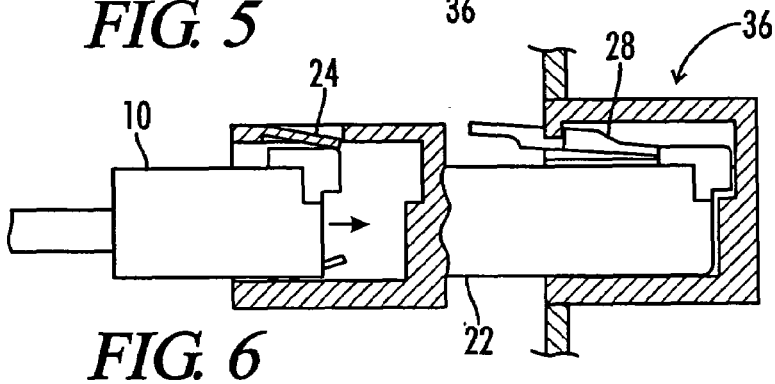
FIG. 6 is a partially sectioned side view of the male plug with broken latching tab being inserted into the electrical adapter, which is being inserted into the receiving unit.
Figure 7:
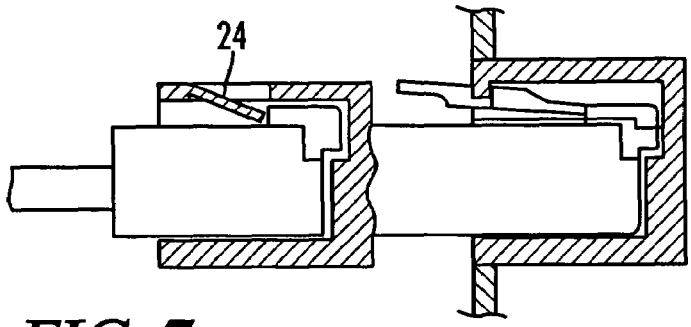
FIG. 7 is a partially sectioned side view showing how the retaining tab of the electrical adapter holds the male plug with broken latching tab in place within the electrical adapter.
Figure 8:
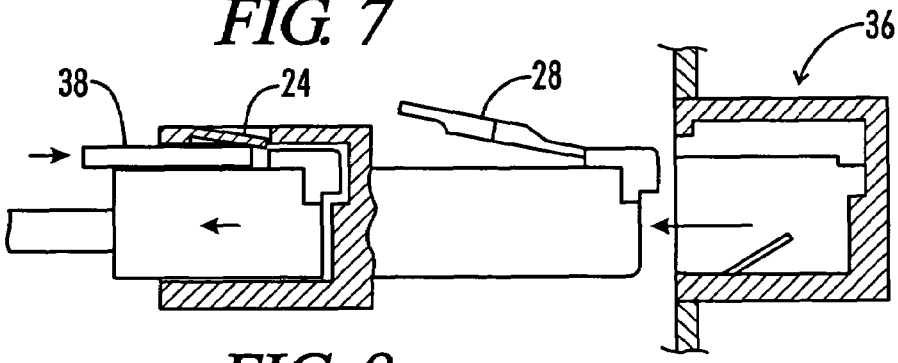
FIG. 8 is a partially sectioned side view which shows how to remove the male plug from the electrical adapter.

Referring now to FIGS. 1 through 8, the male plug (10) has a latching tab (12). This latching tab (12) enables the receiving unit (18) to hold the plug (10) in place when the plug (10) is inserted into the receiving unit (18). Often, the latching tab (12) breaks off or becomes detached from the plug (10). When this happens, the plug (10) and the attached cord (13) generally have to be replaced. Specifically, the plug (10) is attached to the cord (13) in such a way that the plug (10) by itself cannot be replaced without special tools and skills, so it is necessary to either replace the entire cord with plug combination (15), or insert the plug (10) with broken latching tab (12) into some sort of housing such that it can still operate without replacing the entire combination (15). If the entire cord and plug combination (15) is replaced, it is often costly. However, if simply the plug (10) itself could be replaced, it would be more cost effective. The electrical adapter (16) of the present invention is a possible solution and is more cost effective than replacing an entire cord with plug combination (15).

The proposed adapter (16) of the present invention is adaptable to receive a male plug (10) with broken latching tab (12) removed, and is constructed to be received in a receiving unit (18) in a plugging fashion, even though the latching tab (12) is removed from the male plug (10), provided the male plug (10) still has a shoulder (34).

The electrical adapter (16) of the present invention comprises a female end (20) and a male end (22). The female end (20) electrically receives the male plug (10) with broken latching tab (12) removed. The female end (20) includes a retaining tab (24) to hold male plug (10) securely in place. The retaining tab (24) protrudes into the female end (20) of the adapter and abuts the shoulder (34) of the male plug (10) when the male plug (10) is inserted into the adapter female end (20). The retaining tab (24) has the ability to be released in order to release male plug (10). The release is accomplished by a bar that slides into the female end of the device and pushes the retaining tab out of engagement with the shoulder of the male plug so that the male plug can be removed. The female end (20) further includes female end electrical contacts (26). The male end (22) electrically connects the adapter (16) to the receiving unit (18). The receiving unit (18) can be a wall outlet, a hand-set, a telephone, a telephone answering device, or a modem, among other things. The male end (22) includes an unbroken latching tab (28) and is substantially similar in shape to the male plug (10) except for the addition of the unbroken latching tab (28). The male end (22) further contains male end electrical contacts (30).

The electrical adapter (16) of the present invention is also referred to as a latch assembly for replacing a broken latching tab (12) on a male plug (10). The assembly includes a body having a male end (22) and a female end (20). The female end (20) has the ability to hold male plug (10) securely in place and have the ability to be released in order to disengage male plug (10).

The electrical adapter (16) operates in a plugging fashion with the receiving unit (18) and the male plug (10). The electrical adapter (16) comprises a structure made from resilient plastic material.

The electrical adapter (16) is also referred to as a plug and adapter assembly, comprising a plug (10) having a distal end (32) and a retaining shoulder (34) facing away from the distal end (32). The assembly also comprises an adapter body (16) for receiving and retaining the plug (10). The adapter body (16) includes a socket (20) for receiving the plug (10) and a flexible retaining tab (24) extending into the socket (20) for engaging the retaining shoulder of the plug (10) when the plug (10) is received in the socket (20). The adapter (16) also includes a male end (22) shaped like the plug (10), but also has a flexible retaining tab (28) in place of the retaining shoulder of the plug (10).

The present invention contemplates a unique female receptacle for receiving a male connector having a broken latching tab. The female receptacle includes a flexible retaining tab extending into the cavity of the female receptacle. The tab engages the shoulder of a male connector to hold the male connector securely in place inside the female receptacle.

The present invention also includes method for connecting a male plug (10), with a broken latching tab (12) removed, to the female end (36) of a receiving unit (18). The method includes inserting a male plug (10), with broken latching tab (12) removed, into the female end (20) of an adapter (16), pushing on a retaining tab (24) within the adapter female end (20) with the male plug (10) thereby deflecting the retaining tab (24) until the male plug (10) is completely inside the adapter female end (20) and secured into place by the retaining tab (24); and inserting the male end (22) of the adapter (16) into the female end (36) of the receiving unit (18). Prior to inserting the male plug (10) into the adapter (16) the latching tab (12) of the male plug (10) must be broken. The latching tab (28) of the male end (22) of the adapter (16) latches the adapter (16) into the receiving unit (18).

In order to disconnect the male plug (10) with broken latching tab removed (12) from the female end (36) of the receiving unit (18), the method of the present invention includes inserting a releasing device (38) into the female end (20) of the adapter (16) to release the male plug (10). The method further includes pushing on a retaining tab (24) within the female end (20) of the adapter with the releasing device (38) thereby enabling the male plug (10) to be pulled out of the female end (20) of the adapter (16), removing the male plug (10) from the female end (20) of the adapter (16) and removing the releasing device (38) from the female end (20) of the adapter (16).

In the present invention the plug (10) may be a telephone plug, however it will be appreciated that the plug that has been described could be any type of modular plug or electrical plug. Furthermore, the female end of the adapter of the present invention could theoretically be any number of receptacles, such as telephone outlet, telephone unit, telephone answering devices, telephone handsets, modems, etc. The latching tabs and retaining tabs of the present invention may be any number of locking mechanisms that are used in order to lock a plug or male end into a receptacle, socket, or female end of any number of receiving units.

When the latching tab (12) of male plug (10) breaks off, a retaining shoulder (32) remains. The locking mechanisms or retaining tab (24) of the female end of the adapter or the adapter receptacle (20) abuts the shoulder (32) of the male plug (10) when the plug (10) is inserted into the adapter receptacle or female end (20) of the adapter. The retaining tab (24) of the adapter (16) is constructed to lock the plug (10) into the adapter receptacle or female end of the adapter (20). This retaining tab (20) is selectably movable to unlock the male plug (10) from the adapter receptacle or female end (20) of the adapter (16).

While the present invention has been described in connection with preferred embodiments of the various figures, it is to be understood that other similar embodiments may be used or modifications and additions may be made to the described embodiment for performing the same function of the present invention without deviating therefrom. Therefore, the present invention should not be limited to any single embodiment but rather construed in breadth and scope in accordance with the recitation of the appended claims.

Thus, although there have been described particular embodiments of the present invention of a new and useful Latch Assembly for Replacing Broken Latching Tabs on a Male Plug, it is not intended that such references be construed as limitations upon the scope of this invention except as set forth in the following claims.

I claim:

1. An electrical adapter for receiving a male plug having male plug electrical contacts and of the type normally having a latching tab, the male plug being constructed to be received in a receiving unit in a plugging fashion with the male plug designed to be held securely in the receiving unit by its latching tab when the male plug is inserted in the receiving unit, but wherein the male plug has a latching tab damaged to the extent that it will not securely hold the male plug in the receiving unit for which it is designed, the adapter comprising:

a female end for electrically receiving the described damaged male plug, said female end including: a retaining tab to hold the described damaged male plug securely in place in said female end; and female end electrical contacts, said retaining tab having a size, shape and location on said female end to hold said female end electrical contacts in functional engagement with the male plug electrical contacts when a male plug having a damaged latching tab of the type described is inserted in said female end; and a male end for electrically connecting the adapter to the receiving unit in a plugging fashion, said male end including:

a latching tab, the male end being substantially similar in shape to an intact male plug;

and male end electrical contacts.

2. The electrical adapter of claim 1 further including at least one protrusion that normally engages the latching tab of an intact male plug.

3. An electrical adapter for receiving a mating male plug having male plug electrical contacts and having a broken latching tab, the mating male plug being constructed to be received in a receiving unit in a plugging fashion, the adapter comprising:

a female end for electrically receiving the mating male plug having the broken latching tab, said female end including:

a retaining tab protruding into said female end, said retaining tab constructed to be deflected by insertion of the male plug and to hold said broken male plug securely in place; and female end electrical contacts; and a male end including an intact male plug.

4. An electrical adapter for receiving a mating male plug having male plug electrical contacts and having a broken latching tab, the mating male plug being constructed to be received in a receiving unit in a plugging fashion, the adapter comprising:

a female end for electrically receiving the mating male plug having the broken latching tab, said female end including:

a retaining tab resiliently biased into the female end of the adapter, so that upon insertion of the mating male plug having the broken latching tab into the female end of the adapter the retaining tab can deflect to allow insertion of the mating male plug and the retaining tab can then rebound to latch the mating male plug in place to hold said mating male plug having the broken latching tab securely in place; and a male end being substantially similar in shape to an intact male plug for electrically connecting the adapter to the receiving unit in a plugging fashion, said male end including;

a latching tab; and male end electrical contacts.

5. The electrical adapter of claim 1 wherein:

the male plug has a shoulder; and the retaining tab protrudes into the female end of the adapter and abuts the shoulder of the male plug when the male plug is inserted into the adapter female end.

6. An electrical adapter for receiving a male plug having male plug electrical contacts and having a broken latching tab, the male plug being constructed to be received in a receiving unit in a plugging fashion, the adapter comprising:

a female end for electrically receiving the broken male plug, said female end including:

a flexible retaining tab to hold said broken male plug securely in place; and female end electrical contacts; and a male end being substantially similar in shape to an intact male plug for electrically connecting the adapter to the receiving unit in a plugging fashion, said male end including:

a latching tab; and male end electrical contacts.

7. The electrical adapter of claim 1 wherein the male end of the adapter has a body and a shoulder, said shoulder being attached to the unbroken latching tab and to the body.

8. The electrical adapter of claim 1 wherein the adapter is made of a resilient plastic material.

9. A latch assembly for replacing a broken latching tab on a male plug, the male plug having male plug electrical contacts and a broken latching tab, and also having the ability to connect in a plugging fashion into a receiving unit, the latch assembly comprising:

a body including a female end and a male end;

the female end having female end electrical contacts and a retaining tab, said retaining tab having a size, shape and location to hold said female end electrical contacts in functional engagement with the male plug electrical contacts when a damaged male plug of the type described is inserted in said female end; said retaining tab moveable between a first position to hold said male plug securely in place and a second position to disengage said male plug; and said male end having male end electrical contacts and being substantially similar in shape to said broken male plug.

10. A plug and adapter assembly, comprising:

a plug having a distal end, and having a retaining shoulder facing away from the distal end; and an adapter body for receiving and retaining the plug, the adapter body including:

a socket for receiving the plug;

a flexible retaining tab extending into the socket, for engaging the retaining shoulder of the plug when the plug is received in the socket; and a male end shaped like the plug, except having a second flexible retaining tab in place of the retaining shoulder of the plug.

11. A method for connecting a male plug with a broken latching tab to a female end of a receiving unit, said method including:

(a) inserting the male plug into a female end of an adapter;

(b) pushing on a retaining tab within the adapter female end with the male plug thereby deflecting the retaining tab until the male plug is completely inside the adapter female end and secured into place by the retaining tab; and (c) inserting a male end of the adapter into the female end of the receiving unit thereby connecting the adapter and the male plug to the receiving unit.

12. The method of claim 11, further comprising:

prior to step (a), breaking a flexible latching tab on the male plug.

13. The method of claim 11, wherein in step (c), a latching tab of the male end latches the adapter into the receiving unit.

14. An assembly for use with a telephone plug with broken latching tab and telephone plug receptacle, said telephone plug being secured to a telephone cable, said assembly comprising:

an adapter having an adapter receptacle operable for mating with the telephone plug, and the adapter having electrical connectors operable to electrically connect the telephone plug to the telephone plug receptacle;

said adapter including a first locking mechanism to secure the telephone plug into said adapter receptacle, said first locking mechanism being selectively movable to unlock said telephone plug from said adapter receptacle; and a second locking mechanism to secure said adapter into telephone plug receptacle.

15. The assembly of claim 14 wherein the first locking mechanism is constructed to be deflected by insertion of the telephone plug thereby allowing entry of the telephone plug into the adapter receptacle.

16. The assembly of claim 14, wherein the first locking mechanism is resiliently biased into the adapter receptacle, so that upon insertion of the telephone plug into the adapter receptacle the first locking mechanism can deflect to allow insertion of the telephone plug and the first locking mechanism can then rebound to latch the telephone plug in place.

17. An assembly for use with a telephone plug with a broken latching tab and telephone plug receptacle, said telephone plug being secured to a telephone cable, said assembly comprising:

an adapter having an adapter receptacle operable for mating with the telephone plug, and the adapter having electrical connectors operable to electrically connect the telephone plug to the telephone plug receptacle;

said adapter including a first locking mechanism having a retaining tab protruding into the adapter receptacle and constructed to secure the telephone plug into said adapter receptacle, said first locking mechanism being selectively movable to unlock said telephone plug from said adapter receptacle; and a second locking mechanism to secure said adapter into telephone plug receptacle.

18. The assembly of claim 14, wherein said second locking mechanism has a body and a shoulder, said shoulder comprising an unbroken latching tab and being attached to the body.

19. The assembly of claim 14, wherein the adapter is made of a resilient plastic material.

20. A connector receptacle for receiving a male plug attached to the end of an energy conducting line, said male plug being of the type having an energy transmitting contact and a connector arm, said receptacle including at least one shoulder to hold said plug securely in place when the connecting arm is intact and a tab enabling said receptacle to hold said plug securely in place when the connecting arm is broken and an energy transmitting contact to mate with said energy transmitting contact of said plug.

21. The receptacle of claim 20 further including a release bar to disengage said tab so that said plug can be removed from said receptacle.

* * * * *